US012281562B2

(12) United States Patent
Wu et al.

(10) Patent No.: US 12,281,562 B2
(45) Date of Patent: Apr. 22, 2025

(54) CLOSED LOOP FULLY AUTONOMOUS DIRECTIONAL DRILLING

(71) Applicant: Halliburton Energy Services, Inc., Houston, TX (US)

(72) Inventors: Min Wu, Houston, TX (US); Cili Sun, Houston, TX (US); Robert Alan Friedrich, Houston, TX (US); Ketan C. Bhaidasna, Houston, TX (US); Bipin K. Pillai, Houston, TX (US); Fernando Costa Oliveira Chagas, Houston, TX (US); Vy Pho, Houston, TX (US); Nazli Demirer, Tomball, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/595,926

(22) Filed: Mar. 5, 2024

(65) Prior Publication Data

US 2025/0084750 A1 Mar. 13, 2025

Related U.S. Application Data

(60) Provisional application No. 63/538,283, filed on Sep. 13, 2023.

(51) Int. Cl.
*E21B 44/00* (2006.01)
*E21B 7/04* (2006.01)
(Continued)

(52) U.S. Cl.
CPC ..... *E21B 44/00* (2013.01); *E21B 7/04* (2013.01); *E21B 47/022* (2013.01); *E21B 47/12* (2013.01)

(58) Field of Classification Search
CPC ..... E21B 44/00; E21B 7/04; E21B 47/022; E21B 47/12
See application file for complete search history.

(56) References Cited

U.S. PATENT DOCUMENTS 10,508,530 B2 * 12/2019 Gillan ..... E21B 47/06
2010/0139981 A1 * 6/2010 Meister ..... E21B 47/08 175/73

(Continued)

FOREIGN PATENT DOCUMENTS

CN 111810113 A 10/2020
EP 2198114 B1 6/2019

OTHER PUBLICATIONS

International Search Report & Written Opinion; PCT Application No. PCT/US2024/018641; mailed Jun. 21, 2024.

(Continued)

*Primary Examiner* — James G Sayre
(74) *Attorney, Agent, or Firm* — NOVAK DRUCE CARROLL LLP

(57) ABSTRACT

Systems and methods of the present disclosure are directed to systems and methods for controlling a wellbore drilling apparatus where the system may include a surface controller and a downhole controller. In certain instances, control of the drilling apparatus may be transferred from the surface controller to the downhole controller. The control of the drilling apparatus may be transferred to the downhole controller as the surface control monitors operation of the drilling operation. The surface controller may also send a command that transfers control of the drilling apparatus from the downhole controller to the surface controller.

20 Claims, 5 Drawing Sheets

(51) Int. Cl.
*E21B 47/022* (2012.01)
*E21B 47/12* (2012.01)

(56) References Cited

U.S. PATENT DOCUMENTS

2015/0292319 A1* 10/2015 Disko ..... E21B 47/16
367/82
2019/0085683 A1 3/2019 Gillan et al.

OTHER PUBLICATIONS

English abstract of CN111810113A, retrieved from www.espacenet.com on Jun. 24, 2024.

* cited by examiner

CLOSED LOOP FULLY AUTONOMOUS DIRECTIONAL DRILLING

CROSS-REFERENCE TO RELATED APPLICATIONS

This application claims benefit of U.S. Provisional Application No. 63/538,283, filed Sep. 13, 2023, which is incorporated herein by reference.

TECHNICAL FIELD

The present disclosure relates generally to wellbore operations and, more specifically (although not necessarily exclusively), to systems and techniques for performing closed loop, fully autonomous directional drilling.

BACKGROUND

Wells can be drilled to access and produce hydrocarbons such as oil and gas from subterranean geological formations. Wellbore operations can include drilling operations, completion operations, fracturing operations, and production operations. Drilling operations may involve gathering information related to downhole geological formations of the wellbore. The information may be collected by wireline logging, logging while drilling (LWD), measurement while drilling (MWD), drill pipe conveyed logging, or coil tubing conveyed logging.

BRIEF DESCRIPTION OF THE DRAWINGS

The various advantages and features of the present technology will become apparent by reference to specific implementations illustrated in the appended drawings. A person of ordinary skill in the art will understand that these drawings only show some examples of the present technology and would not limit the scope of the present technology to these examples. Furthermore, the skilled artisan will appreciate the principles of the present technology as described and explained with additional specificity and detail through the use of the accompanying drawings in which.

DETAILED DESCRIPTION

Figure 1:
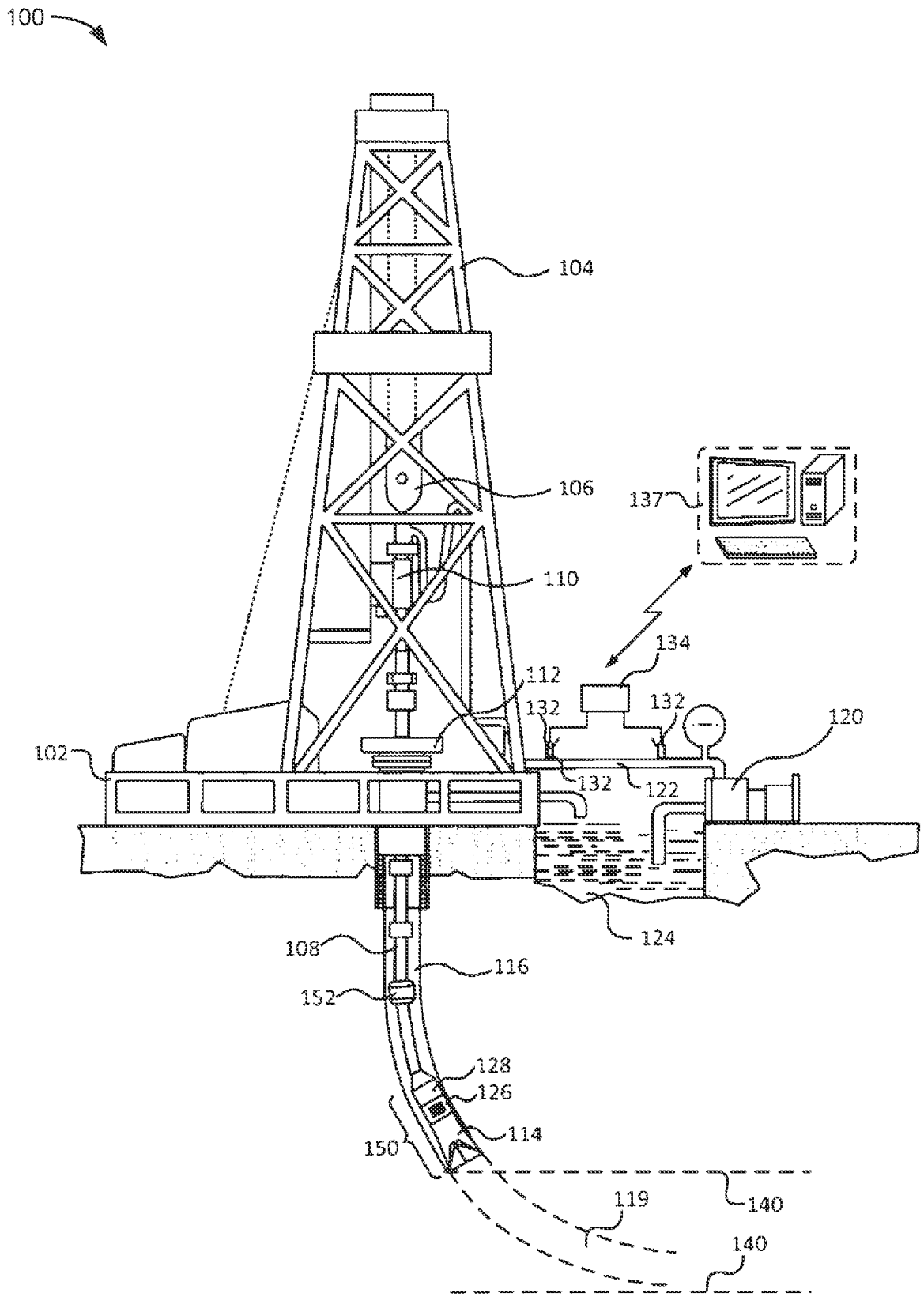
FIG. 1 is a diagram of an illustrative drilling system, in accordance with aspects of the present disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form in order to avoid obscuring the concepts of the subject technology.

Directional drilling, or controlled steering, is used to guide drilling tools in the oil, water, and gas industries to reach resources that are not located directly below a wellhead. Directional drilling particularly provides access to reservoirs where vertical access is difficult if not impossible. In general, directional drilling refers to steering a drilling tool according to a predefined well path plan, having target coordinates and drilling constraints, created by a multidisciplinary team (e.g., reservoir engineers, drilling engineers, geo-steerers, geologists, etc.) to optimize resource collection/discovery.

As the future of directional drilling moves toward exploiting complex reservoirs and difficult to reach resources, it becomes increasingly important for the drilling tool to follow these predefined path plans as closely as possible. Deviations from such pre-defined path plans may result in a waste of resources, damage to the drilling tools, or even undermine the stability of earth formations surrounding a reservoir. Path tracking and guiding drilling tools along the predefined path plans often presents new challenges due, in part, to the physical and operational constraints of the drilling tools, characteristics of rock formations, complex well geometries, and the like.

Furthermore, errors in directional drilling may occur because a human operator (e.g., directional driller) is required to control the equipment and make many quick decisions during the drilling operation. For instance, factors such as unexpected tool behavior, geological conditions (e.g., changes or unexpected conditions), and subjective operator decision making can result in errors in the directional drilling process.

The disclosed technology addresses the foregoing by providing systems and techniques for implementing closed-loop, autonomous directional drilling. In some examples, the present technology may be implemented with drilling and steering systems that can include rotary steering systems (RSS), motorized drilling systems (e.g., mud motors), percussion drilling systems (e.g., hammer drills), electrical impulse drilling systems, other applicable progressive cavity positive displacement pump systems integrated into drill strings, and/or any combination thereof. Using the present technology, the drilling and steering system can quickly react to complicated drilling scenarios, reduce/eliminate operator errors, and achieve the drilling objectives with greater accuracy, efficiency, and cost-effectively.

In some aspects, the present technology may utilize a surface controller that can determine and provide drilling instructions for a drilling and steering system. For instance, the surface controller can provide instructions for drilling in vertical, curved, and/or lateral sections of the wellbore as well as instructions for transitioning among such sections. In some cases, the surface controller can determine the instructions based on the well plan as well as real-time sensor measurements (e.g., downhole measurements). In some instances, the surface controller may also receive and process operator input. The surface controller may confirm and monitor the drilling and steering system status using real-time feedback signals (e.g., monitoring tool performance and/or tool response).

FIG. 1 is a schematic diagram of a directional drilling environment, particularly showing a measurement—while-drilling (MWD) system 100, in which the present technology may be deployed. As depicted, the MWD system 100 includes a drilling platform 102 having a derrick 104 and a hoist 106 to raise and lower a drill string 108. Hoist 106 suspends a top drive 110 suitable for rotating drill string 108 and lowering drill string 108 through a well head 112. In some aspects, drill string 108 may include sensors or other instrumentation for detecting and logging nearby characteristics and conditions of the wellbore and surrounding earth formation.

In operation, top drive 110 supports and rotates drill string 108 as it is lowered through well head 112. In this fashion, drill string 108 (and/or a downhole motor) can rotate a drill bit 114 coupled with a lower end of drill string 108 to create a borehole 116 through various formations. A pump 120 can circulate drilling fluid through a supply pipe 122 to top drive 110, down through an interior of drill string 108, through orifices in drill bit 114, back to the surface via an annulus around drill string 108, and into a retention pit 124. The drilling fluid can transport cuttings from wellbore 116 into retention pit 124 and can help maintain wellbore integrity. Various materials can be used for drilling fluid, including oil-based fluids and water-based fluids.

As shown, drill bit 114 forms part of a bottom hole assembly 150, which further includes drill collars (e.g., thick-walled steel pipe) that provide weight and rigidity to aid drilling processes. In some configurations, detection tools 126 and a telemetry sub 128 can be coupled to or integrated with one or more drilling collars.

In some aspects, detection tools 126 may gather MWD survey data or other data and may include various types of electronic sensors, transmitters, receivers, hardware, software, and/or additional interface circuitry for generating, transmitting, and detecting signals (e.g., sonic waves, etc.), storing information (e.g., log data), communicating with additional equipment (e.g., surface equipment, processors, memory, clocks input/output circuitry, etc.), and the like. For example, detection tools 126 can measure data such as position, orientation, weight-on-bit, strains, movements, borehole diameter, resistivity, drilling tool orientation, which may be specified in terms of a tool face angle (rotational orientation), inclination angle (the slope), compass direction, and/or azimuth angle, each of which can be derived from measurements by sensors (e.g., magnetometers, inclinometers, and/or accelerometers, though other sensor types such as gyroscopes, etc.).

In some cases, telemetry sub 128 can communicate with detection tools 126 and transmits telemetry data to surface equipment (e.g., via mud pulse telemetry). For example, telemetry sub 128 can include a transmitter to modulate resistance of drilling fluid flow thereby generating pressure pulses that propagate along the fluid stream at the speed of sound to the surface. One or more pressure transducers 132 can operatively convert the pressure pulses into electrical signal(s) for a signal digitizer 134. It is appreciated that other forms of telemetry such as acoustic, electromagnetic, telemetry via wired drill pipe, and the like may also be used to communicate signals between downhole drilling tools and signal digitizer 134. Further, it is appreciated that telemetry sub 128 can store detected and logged data for later retrieval at the surface when bottom hole assembly 150 is recovered.

In some instances, digitizer 134 can convert the pressure pulses into a digital signal and sends the digital signal over a communication link to a computing system such as surface controller 137. In some aspects, surface controller 137 can include processing units to analyze collected data and/or perform other operations by executing software or instructions obtained from a local or remote non-transitory computer-readable medium. For instance, surface controller 137 can be used to implement algorithms (e.g., data-based algorithms, physics-based algorithms, machine learning algorithms, etc.) that can be used to autonomously execute a drilling plan.

In some examples, surface controller 137 can receive and execute a drilling plan that includes directional drilling instructions. In some aspects, surface controller 137 can modify the drilling plan based on data received from detection tools 126 (e.g., measured bit position, estimated bit position, bit force, bit force disturbance, rock mechanics, etc.). In some instances, surface controller 137 can adjust borehole assembly dynamics model parameters. In some cases, surface controller 137 can generate drilling status charts, waypoints, a desired borehole path, and/or an estimated borehole path. In some implementations, surface controller 137 can communicate with downhole controller 152 (described further below) to execute a drilling plan, and/or perform other tasks associated with directional drilling. In some configurations, surface controller 137 can include input device(s) (e.g., a keyboard, mouse, touchpad, etc.) as well as output device(s) (e.g., monitors, printers, etc.).

As noted above, MWD system 100 can also include a downhole controller 152 that receives instructions from surface controller 137 in order to steer bottom hole assembly 150 as drill bit 114 extends wellbore 116 along a desired path 119 (e.g., within one or more boundaries 140). The bottom hole assembly includes a drilling and steering system, such as steering vanes, bent stub, or rotary steerable system (RSS), thereby together with the drill bit 114 form a directional drilling tool. Downhole controller 152 includes processors, sensors, and other hardware/software and which may communicate to components of the steering system. For instance, with a RSS, the downhole controller 152 can apply a force to flex or bend a drilling shaft coupled to bottom hole assembly 150, or by steering pads on the outside of a non-rotating housing, can impart an angular deviation to configure the direction traversed by drill bit 114. Downhole controller 152 can communicate real-time data with one or more components of bottom hole assembly 150 and/or surface controller 137. In this fashion, downhole controller 152 can receive real-time steering signals from surface controller 137 according to, for example, optimal trajectory control techniques discussed herein. It is further appreciated by those skilled in the art, the environment shown in FIG. 1 is provided for purposes of discussion only, not for purposes of limitation. The detection tools, drilling devices, and optimal trajectory control techniques discussed herein may be suitable in any number of drilling environments.

As disclosed herein, the environment shown in FIG. 1 is provided for purposes of discussion only, not for purposes of limitation. The detection tools, drilling devices, and control techniques discussed herein may be suitable in any number of drilling environments.

Figure 2:
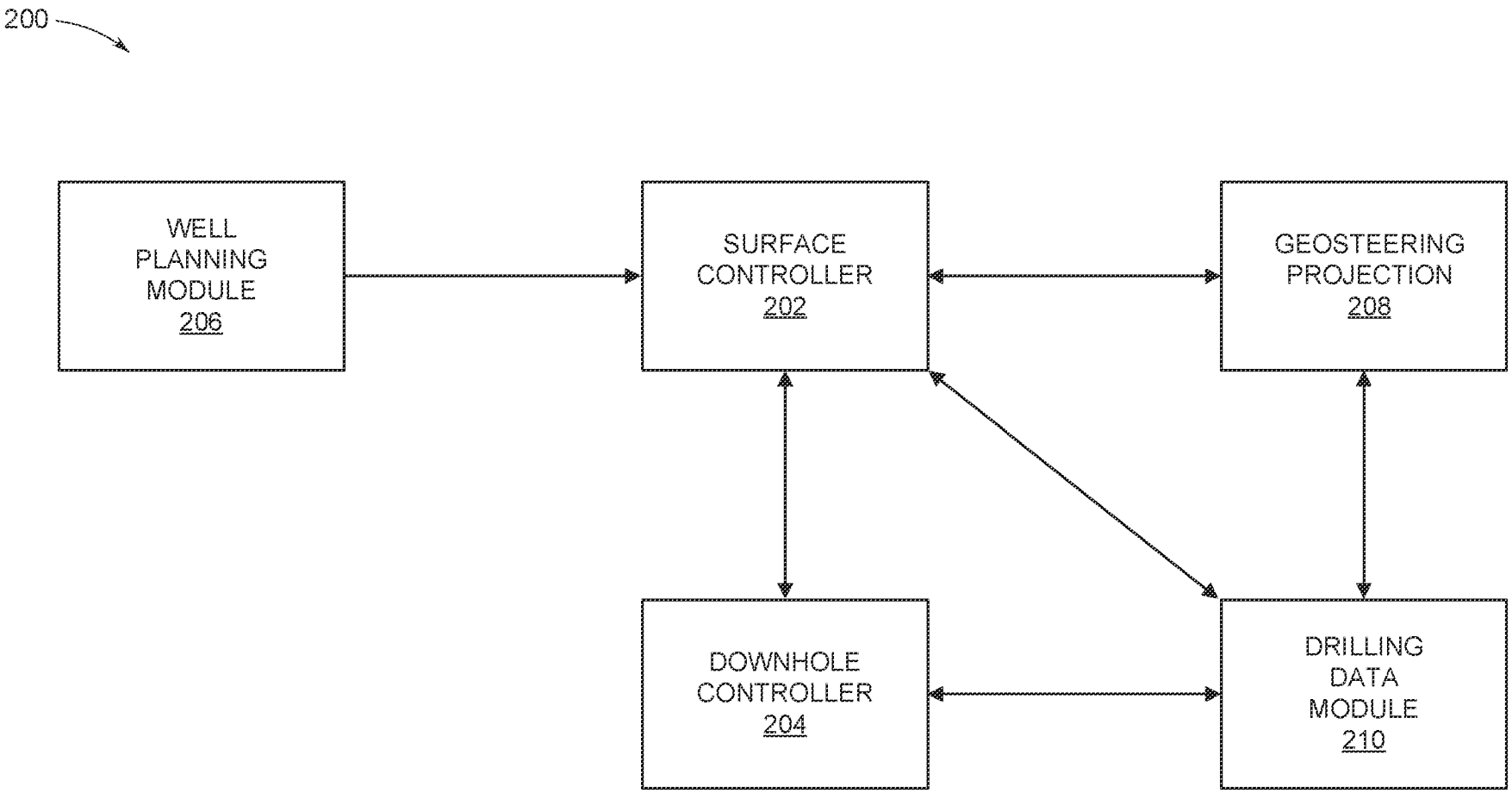
FIG. 2 is a block diagram of an illustrative system for implementing closed-loop, fully autonomous directional drilling, in accordance with aspects of the present disclosure.

FIG. 2 is a block diagram of an illustrative system 200 for implementing closed-loop, fully autonomous directional drilling, in accordance with aspects of the present disclosure. In some examples, the system 200 may include a surface controller 202. In some aspects, surface controller 202 may correspond to surface controller 137 illustrated in FIG. 1.

In some examples, surface controller 202 may receive a well plan from well planning module 206 (e.g., implemented using COMPASS™ software) and/or from geosteering projection module 208. The well plan may include a description of the wellbore, including the shape, orientation, depth, completion, etc. The well plan for directional or horizontal wellbores may include information regarding the location for landing the well and information regarding different sections of the wellbore. For instance, the well plan may include the dimensions of different sections of the wellbore (e.g., lateral sections, vertical sections, curved sections, etc.) and/or waypoints that may be used to perform directional drilling. In some configurations, well planning module 206 and/or geosteering projection module 208 can be used to modify a well plan and the modified well plan can be provided to surface controller 202.

In some aspects, surface controller 202 can use the well plan to determine drilling recommendations, instructions, and/or commands that can be sent to downhole controller 204 (e.g., downhole controller 152 in FIG. 1). That is, surface controller 202 can determine drilling instructions that can include downhole actuation instructions as well as surface drilling parameters (e.g., WOB, RPM, mud flow, power, etc.). For instance, surface controller 202 may provide drilling instructions to downhole controller 204 for controlling a drilling and steering system (e.g., a rotary steerable system (RSS), a motorized drilling and steering system, etc.) to form or drill vertical sections of a wellbore, lateral sections of a wellbore, and/or curved sections of a wellbore. In some aspects, downhole controller 204 may be coupled to a mud motor or to other applicable progressive cavity positive displacement pump systems that may be integrated into drill strings. In addition, surface controller 202 may provide drilling instructions to downhole controller 204 for controlling the drilling and steering system in transitioning among different sections (e.g., real-time transition recommendations between vertical and curve and lateral sections). For instance, surface controller 202 may determine an angle for transitioning from lateral section to a curved section, and surface controller 202 may send an instruction to downhole controller 204 to configure the drilling and steering system to drill at the specified angle. In one illustrative example, the instructions from surface controller 202 to downhole controller 204 may include an azimuth angle and/or an inclination angle for positioning the drill bit associated with the drilling and steering system.

In some configurations, surface controller 202 can send the instructions or recommendations to downhole controller 204 using the downlink and/or some type of telemetry. Examples of downlink may include but are not limited to drill string RPM modulation; mud flow modulation; and/or direct downlink command(s).

In some aspects, surface controller 202 can provide real-time toolface source change instructions or recommendations based on real-time MWD signals and/or LWD signals. The MWD signals can include signals from one or more downhole sensors. For instance, the MWD signals can include signals provided by detection tools 126 (e.g., position, orientation, weight-on-bit, strains, movements, borehole diameter, resistivity, drilling tool orientation, rate of penetration (ROP), rotations per minute (RPM), etc.).

In some examples, surface controller 202 may interface with drilling data module 210. In some aspects, the drilling data module 210 can include one or more downhole sensors (e.g., inclination angle sensor, azimuth sensor, measurement while drilling (MWD) sensors, logging while drilling (LWD) sensor, and/or any other type of sensors). In some cases, the drilling data module 210 can gather, collect, and/or otherwise encapsulate measurement data from downhole tools. In some cases, the measurement data can include directional information (e.g., inclination data, azimuth data, etc.), stratigraphic information (e.g., desired or undesired layer for making steering decisions), rock properties, etc. In some configurations, drilling data module 210 can provide the measurement data to the surface controller 202, to the geosteering projection module 208, and/or to the downhole controller 204. In some cases, the data from drilling data module 210 can be used by the geosteering projection module 208, and/or to the downhole controller 204 to determine or adjust drilling instructions (e.g., downhole actuation, surface drilling parameters, etc.).

In some cases, surface controller 202 can be coupled to geosteering projection module 208. In some configurations, geosteering projection module 208 can provide data (e.g., geological logging measurements) that can be used to steer the drilling and steering system. For example, geosteering projection module 208 can obtain geological logging measurements that surface controller 202 can use to determine instructions for guiding the drilling and steering system. In some cases, the data from geosteering projection module 208 may be used to modify, update, or edit the well plan. For instance, surface controller 202 may use the data from geosteering projection module 208 to determine that a section of the well plan should be changed. In another example, geosteering projection module 208 can interact with surface controller 202 to determine real-time tool yield and bit projection information.

In some examples, surface controller 202 can receive real-time tool status from downhole controller 204 (e.g., via telemetry). In some cases, surface controller 202 can determine when the drilling and steering system has engaged with the drilling commands based on real-time tool response (e.g., received via telemetry and/or from downhole controller 204). In some aspects, surface controller 202 can resend drilling instructions if surface controller 202 determines that the drilling and steering system has not responded to the prior command (e.g., previous command fails).

In some configurations, surface controller 202 and downhole controller 204 can be configured to execute different portions of a well plan. For example, based on the well plan (e.g., from well planning module 206) and/or geosteering data (e.g., from geosteering projection module 208), control of the drilling and steering system can be transferred from surface controller 202 to downhole controller 204, and vice-versa. In one illustrative example, downhole controller 204 may control the drilling and steering system for drilling vertical sections and/or lateral sections of a well plan, and surface controller 202 may control the drilling and steering system for drilling curved sections of the well plan. In another example, downhole controller 204 may be configured to control the drilling and steering system for drilling all portions of a well plan (e.g., vertical, lateral, and curved). In some cases, surface controller 202 may be configured to operate in a supervisory fashion while downhole controller 204 is controlling the drilling and steering system. That is, surface controller 202 can monitor data from downhole tools and/or drilling data module 210 to confirm that the well plan is being executed. In some cases, surface controller 202 may pause drilling or re-take control of the drilling and steering system by sending a command to downhole controller 204.

In some aspects, surface controller 202 may be coupled to a user interface (not illustrated) that can be used to receive input from an operator (e.g., a directional driller). For instance, surface controller 202 may send a manual command to downhole controller 204 based on operator input. In some aspects, surface controller 202 may validate the manual command prior to sending it to downhole controller 204 to ensure that the command does not violate aspects of the well plan.

In some configurations, surface controller 202 can perform post-job analysis (e.g., at the completion of the wellbore or a portion thereof). For instance, surface controller 202 can generate a report that provides key performance indicators (KPIs) associated with the directional drilling project. In some cases, surface controller 202 can perform drilling command analysis that can be used to improve future directional drilling projects. For example, in some configurations, one or more aspects of surface controller 202 can be implemented using one or more machine learning models. In some cases, data from directional drilling of a wellbore can be used to train the machine learning model. In one illustrative example, KPIs can be used to configure as a cost function that can be minimized in accordance with the drilling instructions that are generated by a machine learning model based on the well plan.

Figure 3:
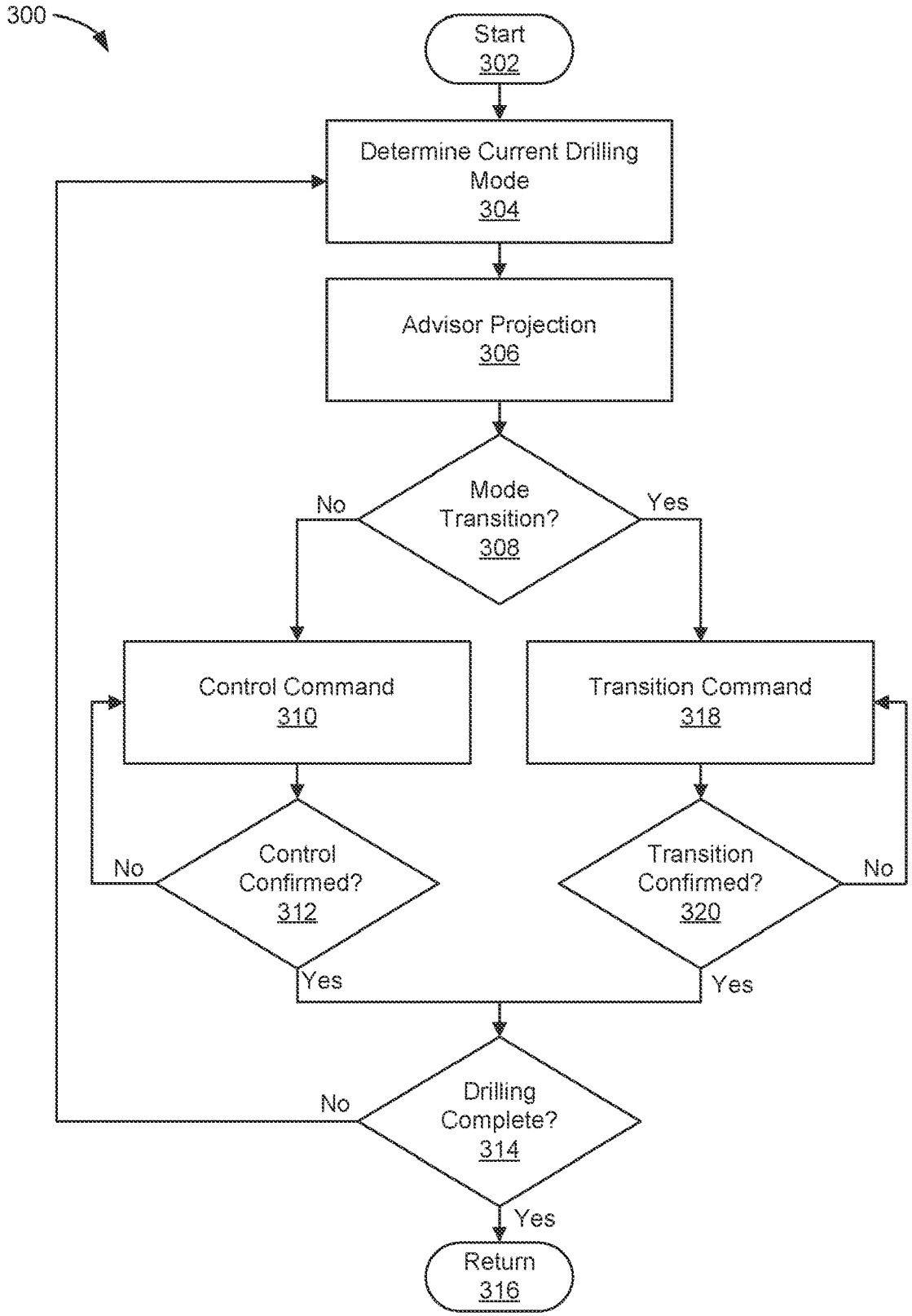
FIG. 3 is a flowchart of an illustrative process for implementing closed-loop, fully autonomous directional drilling, in accordance with aspects of the present disclosure.

FIG. 3 illustrates an example of a process 300 for performing closed loop, fully autonomous directional drilling with a drilling and steering system, in accordance with aspects of the present disclosure. In some aspects, the process 300 can be performed by a surface controller such as surface controller 202 and/or surface controller 137. In some examples, the process 300 can begin at step 302, which may include initializing of hardware or software systems associated with a directional drilling system and/or any other component or device that may be configured to execute one or more steps of process 300.

At step 304, the surface controller can determine a current drilling mode. In some aspects, the current drilling mode may correspond to a vertical drilling mode, a curved drilling mode, or a lateral drilling mode. At step 306, the surface controller can determine an advisor projection. That is, the surface controller can use the well plan to determine instructions for the drilling and steering system (e.g., whether a mode transition is needed or not).

At step 308, the surface controller can determine whether a mode transition is needed in order to continue to execute the well plan. Also, in some aspects, the surface controller may consider feedback from downhole sensors, from a geosteering projection module, and/or from a drilling data module to determine whether modifications of the well plan are required. If the surface controller determines that a mode transition is not required, the process 300 can proceed to step 310 and the surface controller can send a control command to the downhole controller (e.g., downhole controller 204).

At step 312, the surface controller can determine whether the control command was confirmed. That is, the surface controller can determine whether the drilling and steering system is performing in accordance with the control command. In some examples, the surface controller may receive information via telemetry (e.g., from detection tools 126) that can be used to determine whether the control command was confirmed. If the command was not confirmed, the process 300 can return to step 310 and resend the control command. If the command was confirmed, the process 300 can proceed to step 314 to determine whether drilling is complete (e.g., wellbore has been completed according to the well plan). If drilling is not complete, the process can be repeated by returning to step 304. If drilling is complete, the process can end at step 316. In some aspects, concluding or ending process 300 can include gathering KPI data and/or generating drilling reports that can be used to modify and/or improve future drilling operations.

Returning to step 308, if the surface controller determines that a mode transition is required (e.g., transition between vertical, curve, and/or lateral sections of wellbore), the process 300 can continue to step 318 and the surface controller can send a transition command. At step 320, the surface controller can determine whether the transition command was confirmed (e.g., whether the drilling and steering system is operating in accordance with the transition command). As noted above with respect to the control command, the transition command can be confirmed via telemetry.

In some aspects, if the transition command is not confirmed, the process 300 can return to step 318 and the surface controller can resend the command to the downhole controller. If the transition command is confirmed, the process 300 can proceed to step 314 to determine whether drilling is complete. As noted above, if drilling is not complete one or more steps of process 300 can be repeated. If the drilling is complete, the process 300 can end at step 316.

Figure 4:
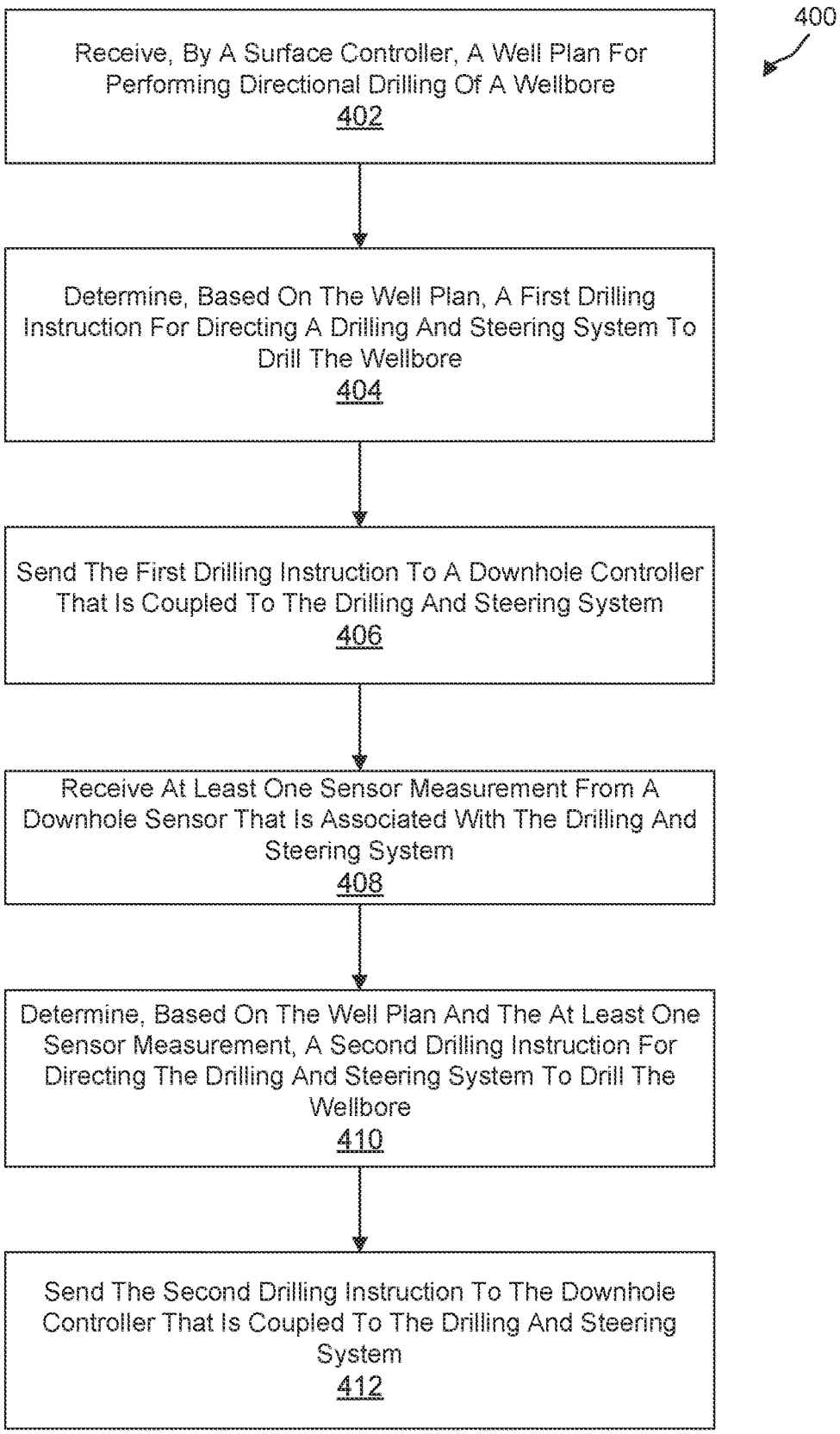
FIG. 4 is a flowchart of another illustrative process for implementing closed-loop, fully autonomous directional drilling, in accordance with aspects of the present disclosure.

FIG. 4 illustrates an example of a process 400 for performing closed loop, fully autonomous directional drilling with drilling and steering system, in accordance with aspects of the present disclosure. Although the process 400 depicts a particular sequence of operations, the sequence may be altered without departing from the scope of the present disclosure. For example, some of the operations depicted may be performed in parallel or in a different sequence that does not materially affect the function of process 400. In other examples, different components of an example device or system that implements process 400 may perform functions at substantially the same time or in a specific sequence.

At block 402, the process 400 includes receiving, by a surface controller, a well plan for performing directional drilling of a wellbore. For example, surface controller 202 can receive a well plan for performing directional drilling of a wellbore from well planning module 206 and/or geosteering projection module 208.

At block 404, the process 400 includes determining, based on the well plan, a first drilling instruction for directing a drilling and steering system to drill the wellbore. For example, surface controller 202 can use the well plan to determine a first drilling instruction for directing a drilling and steering system to drill the wellbore. In some aspects, the first drilling instruction can correspond to at least one of a vertical section of the wellbore, a lateral section of the wellbore, and a curved section of the wellbore. In some examples, the first drilling instruction can also include one or more drilling parameters. For example, the first drilling instruction can include a weight-on-bit (WOB) parameter, a rotations-per-minute (RPM) parameter, a flow parameter (e.g., mud flow), a power parameter, etc. In some examples, the drilling and steering system may correspond to a rotary steering system (RSS). In some cases, the drilling and steering system may correspond to a motorized drilling system (e.g., mud motor), a percussion drilling system (e.g., hammer drill), an electrical impulse drilling system, or any drilling system such as other applicable progressive cavity positive displacement pump systems integrated into drill strings.

At block 406, the process 400 includes sending the first drilling instruction to a downhole controller that is coupled to the drilling and steering system. For instance, surface controller 202 can send the first drilling instruction to downhole controller 204, which is coupled to the drilling and steering system. In some cases, the first drilling instruction can be sent to the downhole controller using a downlink protocol.

At block 408, the process 400 includes receiving at least one sensor measurement from a downhole sensor that is associated with the drilling and steering system. For instance, surface controller 202 can receive at least one sensor measurement from a downhole sensor (e.g., detection tools 126). In some examples, the at least one sensor measurement can include at least one of an azimuth of the wellbore and an inclination of the wellbore.

At block 410, the process 400 includes determining, based on the well plan and the at least one sensor measurement, a second drilling instruction for directing the drilling and steering system to drill the wellbore. For example, surface controller 202 can determine, based on the well plan and the sensor data, a second drilling instruction for directing the drilling and steering system. In some aspects, the second drilling instruction can correspond to a first transition between the vertical section of the wellbore and the curved section of the wellbore or a second transition between the curved section of the wellbore and the lateral section of the wellbore.

At block 412, the process 400 includes sending the second drilling instruction to the downhole controller that is coupled to the drilling and steering system. For instance, surface controller 202 can send the second drilling instruction to downhole controller 204.

In some aspects, the process 400 can include receiving real-time wellbore data from a geosteering application; determining, based on the real-time wellbore data, a third drilling instruction for directing the drilling and steering system to drill the wellbore; and sending the third drilling instruction to the downhole controller that is coupled to the drilling and steering system. For example, surface controller 202 can receive real-time wellbore data from geosteering projection module 208 and determine, based on the wellbore data, a third drilling instruction for directing the drilling and steering system to drill the wellbore. In some aspects, surface controller 202 can send the third drilling instruction to downhole controller 204.

In some configurations, the process 400 can include receiving a user input that includes a manual instruction for the downhole controller; and sending the manual instruction to the downhole controller that is coupled to the drilling and steering system. For example, surface controller 202 may include a user interface to enable an operator (e.g., directional driller) to provide user input that includes a manual instruction for the downhole controller. Surface controller 202 can send the manual instruction from the operator to downhole controller 204.

In some instances, the process 400 can include determining that the drilling and steering system failed to respond to the first drilling instruction; and in response, resending the first drilling instruction to the downhole controller that is coupled to the drilling and steering system. For instance, surface controller 202 can use telemetry to determine that the drilling and steering system is not operating in accordance with the first drilling instruction. In response, surface controller 202 can resend the first drilling instruction to downhole controller 204.

In some cases, the surface controller can include a machine learning model that is trained to control the drilling and steering system based on the well plan. For example, surface controller 202 may include one or more machine learning models for controlling a drilling and steering system (e.g., via downhole controller 204).

Figure 5:
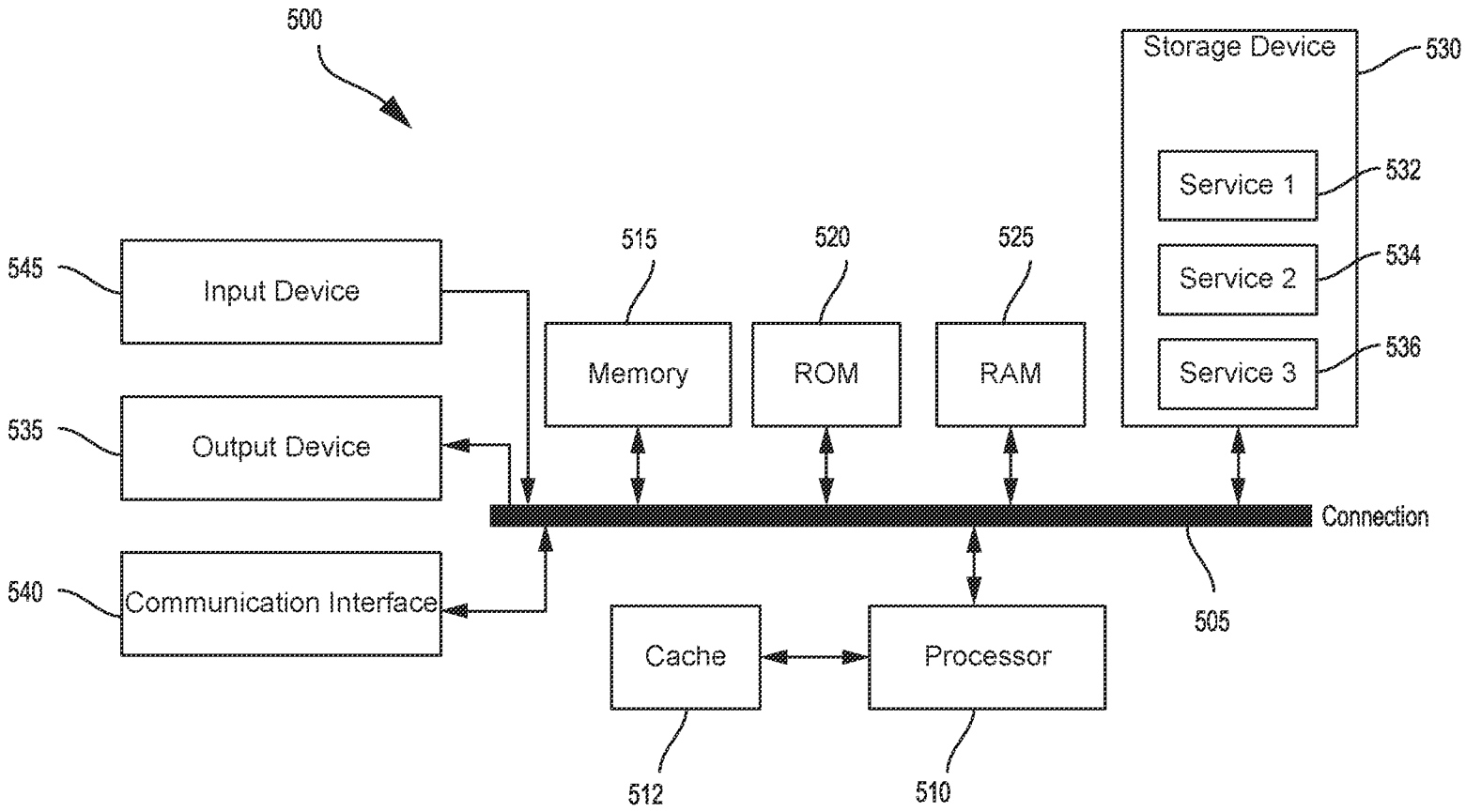
FIG. 5 is a block diagram illustrating an example computing device architecture, in accordance with aspects of the present disclosure.

FIG. 5 illustrates an example computing device architecture 500 which can be employed to perform various steps, methods, and techniques disclosed herein. Specifically, the techniques described herein can be implemented, at least in part, through the computing device architecture 500 in an applicable computing device, such as surface controller 202, downhole controller 204, and/or detection tools 126. The various implementations will be apparent to those of ordinary skill in the art when practicing the present technology. Persons of ordinary skill in the art will also readily appreciate that other system implementations or examples are possible.

As noted above, FIG. 5 illustrates an example computing device architecture 500 of a computing device which can implement the various technologies and techniques described herein. The components of the computing device architecture 500 are shown in electrical communication with each other using a connection 505, such as a bus. The example computing device architecture 500 includes a processing unit (CPU or processor) 510 and a computing device connection 505 that couples various computing device components including the computing device memory 515, such as read only memory (ROM) 520 and random access memory (RAM) 525, to the processor 510.

The computing device architecture 500 can include a cache of high-speed memory connected directly with, in close proximity to, or integrated as part of the processor 510. The computing device architecture 500 can copy data from the memory 515 and/or the storage device 530 to the cache 512 for quick access by the processor 510. In this way, the cache can provide a performance boost that avoids processor 510 delays while waiting for data. These and other modules can control or be configured to control the processor 510 to perform various actions. Other computing device memory 515 may be available for use as well. The memory 515 can include multiple different types of memory with different performance characteristics. The processor 510 can include any general purpose processor and a hardware or software service, such as service 1 532, service 2 534, and service 3 536 stored in storage device 530, configured to control the processor 510 as well as a special-purpose processor where software instructions are incorporated into the processor design. The processor 510 may be a self-contained system, containing multiple cores or processors, a bus, memory controller, cache, etc. A multi-core processor may be symmetric or asymmetric.

To enable user interaction with the computing device architecture 500, an input device 545 can represent any number of input mechanisms, such as a microphone for speech, a touch-sensitive screen for gesture or graphical input, keyboard, mouse, motion input, speech and so forth. An output device 535 can also be one or more of a number of output mechanisms known to those of skill in the art, such as a display, projector, television, speaker device, etc. In some instances, multimodal computing devices can enable a user to provide multiple types of input to communicate with the computing device architecture 500. The communications interface 540 can generally govern and manage the user input and computing device output. There is no restriction on operating on any particular hardware arrangement and therefore the basic features here may easily be substituted for improved hardware or firmware arrangements as they are developed.

Storage device 530 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 525, read only memory (ROM) 520, and hybrids thereof. The storage device 530 can include services 532, 534, 536 for controlling the processor 510. Other hardware or software modules are contemplated. The storage device 530 can be connected to the computing device connection 505. In one aspect, a hardware module that performs a particular function can include the software component stored in a computer-readable medium in connection with the necessary hardware components, such as the processor 510, connection 505, output device 535, and so forth, to carry out the function.

For clarity of explanation, in some instances the present technology may be presented as including individual functional blocks including functional blocks comprising devices, device components, steps or routines in a method embodied in software, or combinations of hardware and software.

In some examples the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific examples thereof, but those skilled in the art will recognize that the application is not limited thereto. Thus, while illustrative examples of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, examples can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate examples, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other aspects of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A method comprising: receiving, by a surface controller, a well plan for performing directional drilling of a wellbore; determining, based on the well plan, a first drilling instruction for directing a drilling and steering system to drill the wellbore; sending the first drilling instruction to a downhole controller that is coupled to the drilling and steering system; receiving at least one sensor measurement from a downhole sensor that is associated with the drilling and steering system; determining, based on the well plan and the at least one sensor measurement, a second drilling instruction for directing the drilling and steering system to drill the wellbore; and sending the second drilling instruction to the downhole controller that is coupled to the drilling and steering system.

Statement 2: The method of Statement 1, further comprising: receiving real-time wellbore data from a geosteering application; determining, based on the real-time wellbore data, a third drilling instruction for directing the drilling and steering system to drill the wellbore; and sending the third drilling instruction to the downhole controller that is coupled to the drilling and steering system.

Statement 3: The method of any of Statements 1 to 2, wherein the first drilling instruction corresponds to at least one of a vertical section of the wellbore, a lateral section of the wellbore, and a curved section of the wellbore.

Statement 4: The method of any of Statements 1 to 3, wherein the second drilling instruction corresponds to a first transition between a vertical section of the wellbore and a curved section of the wellbore or a second transition between the curved section of the wellbore and a lateral section of the wellbore.

Statement 5: The method of any of Statements 1 to 4, wherein the first drilling instruction is sent to the downhole controller using a downlink protocol.

Statement 6: The method of any of Statements 1 to 5, further comprising: receiving a user input that includes a manual instruction for the downhole controller; and sending the manual instruction to the downhole controller that is coupled to the drilling and steering system.

Statement 7: The method of any of Statements 1 to 6, further comprising: determining that the drilling and steering system failed to respond to the first drilling instruction; and in response, resending the first drilling instruction to the downhole controller that is coupled to the drilling and steering system.

Statement 8: The method of any of Statements 1 to 7, wherein the surface controller includes a machine learning model that is trained to control the drilling and steering system based on the well plan.

Statement 9: The method of any of Statements 1 to 8, wherein the at least one sensor measurement includes at least one of an azimuth of the wellbore and an inclination of the wellbore.

Statement 10: An apparatus comprising at least one memory; and at least one processor coupled to the at least one memory, wherein the at least one processor is configured to perform operations in accordance with any one of Statements 1 to 9.

Statement 11: An apparatus comprising means for performing operations in accordance with any one of Statements 1 to 9.

Statement 12: A non-transitory computer-readable medium comprising instructions that, when executed by an apparatus, cause the apparatus to perform operations in accordance with any one of Statements 1 to 9.

Statement 13: A drilling and steering system comprising: a drilling apparatus; a downhole controller that is coupled to the drilling apparatus; and a surface controller that is coupled to the downhole controller and the drilling apparatus.

Statement 14: The drilling and steering system of Statement 13, wherein the surface controller is configured to: determine, based on a well plan, a first drilling instruction for directing the drilling apparatus to perform directional drilling of a first section of a wellbore; and transfer, based on the well plan, control of the drilling apparatus to the downhole controller, wherein the downhole controller is configured to: determine, based on the well plan, a second drilling instruction for directing the drilling apparatus to perform directional drilling of a second section of the wellbore.

Statement 15: The drilling and steering system of Statement 14, wherein the first section of the wellbore corresponds to a vertical section of the wellbore and the second section of the wellbore corresponds to at least one of a curved section of the wellbore and a lateral section of the wellbore.

What is claimed is:

1. A system comprising:

a memory; and one or more processors coupled to the memory, the one or more processors being configured to:

receive, by a surface controller, a well plan for performing directional drilling of a wellbore;

determine, based on the well plan, a first drilling instruction for directing a drilling and steering system to drill the wellbore;

send the first drilling instruction to a downhole controller that is coupled to the drilling and steering system, wherein the first drilling instruction configures the downhole controller to control the drilling and steering system as the surface controller monitors operation of the drilling and steering system;

receive at least one sensor measurement from a downhole sensor that is associated with the drilling and steering system;

determine, based on the well plan and the at least one sensor measurement, a second drilling instruction for directing the drilling and steering system to drill the wellbore; and send the second drilling instruction to the downhole controller that is coupled to the drilling and steering system, wherein the downhole controller controls the drilling and steering system based on the downhole controller being configured to control the drilling and steering system.

2. The system of claim 1, wherein the one or more processors are further configured to:

receive real-time wellbore data from a geosteering application;

determine, based on the real-time wellbore data, a third drilling instruction for directing the drilling and steering system to drill the wellbore to pause the drilling and steering system or transfer control of the drilling and steering system to the surface controller; and send the third drilling instruction to the downhole controller that is coupled to the drilling and steering system, wherein the downhole controller pauses the drilling and steering system or transfers control of the drilling and steering system to the surface controller according to the third instruction.

3. The system of claim 1, wherein the one or more processors execute instructions out of the memory to send a third instruction to the downhole controller to transfer control of the drilling and steering system to the surface controller.

4. The system of claim 1, wherein the second drilling instruction corresponds to a first transition between a vertical section of the wellbore and a curved section of the wellbore or a second transition between the curved section of the wellbore and a lateral section of the wellbore.

5. The system of claim 1, wherein the first drilling instruction is sent from the surface controller to the downhole controller to transfer control of the drilling and steering system from the surface controller to the downhole controller and the first drilling instruction includes one or more drilling parameters, and wherein the one or more drilling parameters include at least one of a weight-on-bit (WOB) parameter, a rotations-per-minute (RPM) parameter, a flow parameter, and a power parameter.

6. The system of claim 1, wherein the one or more processors are further configured to:

receive a user input that includes a manual instruction for the downhole controller; and send the manual instruction to the downhole controller that is coupled to the drilling and steering system.

7. The system of claim 1, wherein the one or more processors are further configured to:

determine that the drilling and steering system failed to respond to the first drilling instruction; and in response, resend the first drilling instruction to the downhole controller that is coupled to the drilling and steering system.

8. The system of claim 1, wherein the surface controller includes a machine learning model that is trained to control the drilling and steering system based on the well plan.

9. The system of claim 1, wherein the at least one sensor measurement includes at least one of an azimuth of the wellbore and an inclination of the wellbore.

10. A computer-implemented method comprising:

receiving, by a surface controller, a well plan for performing directional drilling of a wellbore;

determining, based on the well plan, a first drilling instruction for directing a drilling and steering system to drill the wellbore;

sending the first drilling instruction to a downhole controller that is coupled to the drilling and steering system, wherein the first drilling instruction configures the downhole controller to control the drilling and steering system as the surface controller monitors operation of the drilling and steering system;

receiving at least one sensor measurement from a downhole sensor that is associated with the drilling and steering system;

determining, based on the well plan and the at least one sensor measurement, a second drilling instruction for directing the drilling and steering system to drill the wellbore; and sending the second drilling instruction to the downhole controller that is coupled to the drilling and steering system, wherein the downhole controller controls the drilling and steering system based on the downhole controller being configured to control the drilling and steering system.

11. The computer-implemented method of claim 10, further comprising:

receiving real-time wellbore data from a geosteering application;

determining, based on the real-time wellbore data, a third drilling instruction for directing the drilling and steering system to drill the wellbore; and sending the third drilling instruction to the downhole controller that is coupled to the drilling and steering system, wherein the downhole controller pauses the drilling and steering system or transfers control of the drilling and steering system to the surface controller according to the third instruction.

12. The computer-implemented method of claim 10, wherein a third instruction is sent to the downhole controller to transfer control of the drilling and steering system to the surface controller.

13. The computer-implemented method of claim 10, wherein the second drilling instruction corresponds to a first transition between a vertical section of the wellbore and a curved section of the wellbore or a second transition between the curved section of the wellbore and a lateral section of the wellbore.

14. The computer-implemented method of claim 10, wherein the first drilling instruction is sent to the downhole controller using a downlink protocol.

15. The computer-implemented method of claim 10, further comprising:

receiving a user input that includes a manual instruction for the downhole controller; and sending the manual instruction to the downhole controller that is coupled to the drilling and steering system.

16. The computer-implemented method of claim 10, further comprising:

determining that the drilling and steering system failed to respond to the first drilling instruction; and in response, resending the first drilling instruction to the downhole controller that is coupled to the drilling and steering system.

17. The computer-implemented method of claim 10, wherein the surface controller includes a machine learning model that is trained to control the drilling and steering system based on the well plan.

18. The computer-implemented method of claim 10, wherein the at least one sensor measurement includes at least one of an azimuth of the wellbore and an inclination of the wellbore.

19. A drilling and steering system comprising:

a drilling apparatus;

a downhole controller that is coupled to the drilling apparatus; and a surface controller that is coupled to the downhole controller and the drilling apparatus, wherein the surface controller is configured to:

determine, based on a well plan, a first drilling instruction for directing the drilling apparatus to perform directional drilling of a first section of a wellbore; and transfer, based on the well plan, control of the drilling apparatus to the downhole controller as the surface controller monitors operation of the drilling apparatus, wherein the downhole controller is configured to: determine, based on the well plan, a second drilling instruction for directing the drilling apparatus to perform directional drilling of a second section of the wellbore, and the downhole controller controls the drilling and steering system based on the downhole controller being configured to control the drilling and steering system.

20. The drilling and steering system of claim 19, wherein the surface controller sends a third instruction to the downhole controller to transfer control the drilling and steering system to the surface controller.

* * * * *